United States Patent [19]

Simpson et al.

[11] Patent Number: 4,619,892

[45] Date of Patent: Oct. 28, 1986

[54] COLOR PHOTOGRAPHIC ELEMENT CONTAINING THREE SILVER HALIDE LAYERS SENSITIVE TO INFRARED

[75] Inventors: Sharon M. Simpson, Lake Elmo; John M. McQuade; John R. Boon, both of Woodbury, all of Minn.

[73] Assignee: Minnesota Mining and Manufacturing Company, St. Paul, Minn.

[21] Appl. No.: 795,985

[22] Filed: Nov. 7, 1985

Related U.S. Application Data

[63] Continuation-in-part of Ser. No. 709,561, Mar. 8, 1985, abandoned, which is a continuation-in-part of Ser. No. 674,583, Nov. 26, 1984, abandoned.

[51] Int. Cl.[4] ..... G03C 1/40; G03C 1/46; G03C 5/16

[52] U.S. Cl. ..... 430/505; 430/217; 430/220; 430/363; 430/507; 430/508; 430/509; 430/944

[58] Field of Search ..... 430/505, 507, 509, 944, 430/508, 363, 217, 220

[56] References Cited

U.S. PATENT DOCUMENTS

| | | | |
|---|---|---|---|
| 3,849,138 | 11/1974 | Wyckoff et al. | 430/507 |
| 4,416,522 | 11/1983 | Webster | 354/4 |
| 4,469,779 | 9/1984 | Saits | 430/507 |

*Primary Examiner*—Richard L. Schilling
*Attorney, Agent, or Firm*—Donald M. Sell; James A. Smith; Mark A. Litman

[57] ABSTRACT

Full color photographic images are produced by exposure of a radiation-sensitive element comprising at least three silver halide emulsion layers. At least two silver halide emulsion layers are sensitized to infrared radiation. Selectively absorptive filter layers and/or differential sensitivities between emulsion layers are used to prevent exposure of other layers to radiation used to expose a single layer.

37 Claims, 4 Drawing Figures

COLOR PHOTOGRAPHIC ELEMENT CONTAINING THREE SILVER HALIDE LAYERS SENSITIVE TO INFRARED

CROSS-REFERENCE TO RELATED APPLICATIONS

This is a continuation-in-part of U.S. patent application Ser. No. 709,561, filed Mar. 8, 1985, now abandoned, which is a continuation-in-part of U.S. patent application Ser. No. 674,583 filed Nov. 26, 1984, now abandoned.

BACKGROUND OF THE INVENTION

1. Field of the Invention

This invention relates to color photographic elements and in particular to color photographic elements capable of providing full color images with exposure of at least two silver halide emulsion layers to radiation outside the visible region of the electromagnetic spectrum. In particular, the present invention relates to a color photographic element having at least three emulsion layers associated with color image providing materials, each emulsion layer being sensitized to a different region of the electromagnetic spectrum and at least two layers being sensitized to radiation within the infrared region of the electromagnetic spectrum.

2. Background Art

Dyes which have been capable of sensitizing silver halide emulsions to infrared regions of the electromagnetic spectrum have been known for many years. Merocyanine dyes and cyanine dyes, particularly those with longer bridging groups between cyclic moieties have been used for many years to sensitize silver halide to the infrared. U.S. Pat. Nos. 3,619,154, 3,682,630; 2,895,955; 3,482,978; 3,758,461 and 2,734,900; and U.K. Patent Nos. 1,192,234 and 1,188,784 disclose well-known classes of dyes which sensitize silver halide to portions of the infrared region of the electromagnetic spectrum. U.S. Pat. No. 4,362,800 discloses dyes used to sensitize inorganic photoconductors to the infrared, and these dyes are also effective sensitizers for silver halide.

With the advent of lasers, and particularly solid state laser diodes emitting in the infrared region of the electromagnetic spectrum (e.g., 780 to 1500 nm), the interest in infrared sensitization has greatly increased. Many different processes and articles useful with laser diodes have been proposed. U.S. Pat. No. 4,416,522, for example, proposes daylight photoplotting apparatus for the infrared exposure of film. This patent also generally proposes a film comprising three emulsion layers sensitized to different portions of non-visible portions of the electromagnetic spectrum, including the infrared. The film description is quite general and the concentration of imagewise exposure on each layer appears to be dependent upon filtering of radiation by the apparatus prior to its striking the film surface.

BRIEF DESCRIPTION OF THE INVENTION

A photographic element is described which is capable of providing full color images without exposure to corresponding visible radiation. The element comprises at least three silver halide emulsion layers on a substrate. The at least three emulsion layers are each associated with different photographic color image forming materials, such as color couplers capable of forming dyes of different colors upon reaction with an oxidized color photographic developer, diffusing dyes, bleachable dyes, or oxidizable leuco dyes. The three emulsion layers are sensitized to three different portions of the electromagnetic spectrum with at least two layers sensitized to different regions of the infrared region of the electromagnetic spectrum. The layers must be in a construction that prevents or reduces the exposure of layers by radiation intended to expose only one other layer. This is done by providing differences in speed of emulsions sensitive to different wavelengths of the infrared.

DETAILED DESCRIPTION OF THE DRAWINGS

Figure 1A:
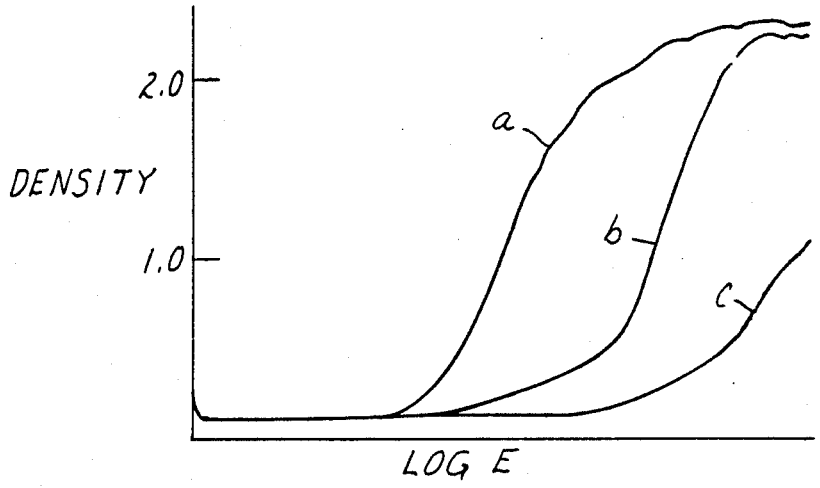
FIGS. 1A, 1B, and 1C show the D vs logE curves for the photographic element of Example 1 after exposure to radiation having wavelengths 780 nm, 830 nm, and 890 nm, respectively.

FIG. 1A shows the D vs logE curve for the photographic element of Example 1 when exposed to 780 nm radiation. Curve (a) shows the density of the yellow-forming layer which is sensitized to 780 nm. Curve (b) shows the density of the magenta-forming layer which is sensitized to 830 nm. Curve (c) shows the density of the cyan-forming layer which is sensitized to 880 nm.

Figure 1B:
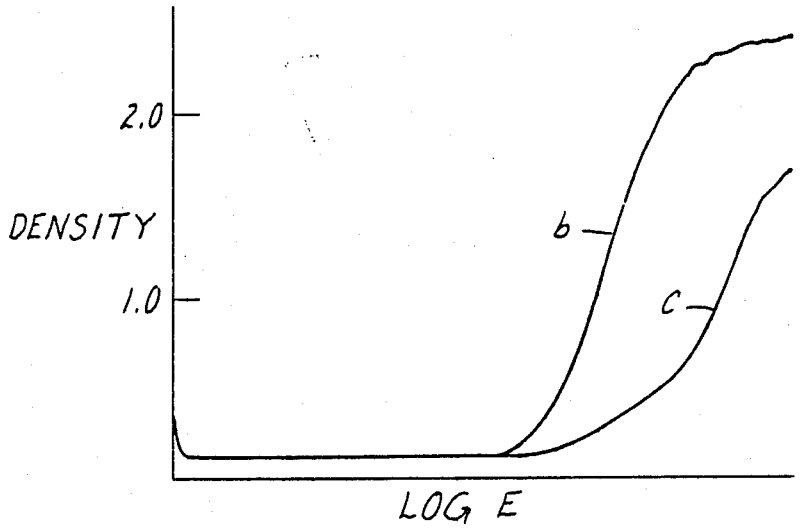

Secondary absorption is observed in the low density regions (0.1 to 0.5) of the cyan and magenta color D logE curves. These unwanted low density bumps are due to residual green absorption characteristics of the yellow dye or the residual red absorption characteristics of the magenta dye and are read with the green or red filters of the densitometer. The same secondary absorption in the cyan curve of FIG. 1B is also observed. Subtraction of these unwanted color-related absorptions from the actual exposure curves would yield adequate separation.

FIG. 1B shows the D vs logE curve for the photographic element of Example 1 when exposed to 830 nm radiation. Curve (b) shows the magenta-forming layer and Curve (c) shows the cyan-forming layer.

Figure 1C:
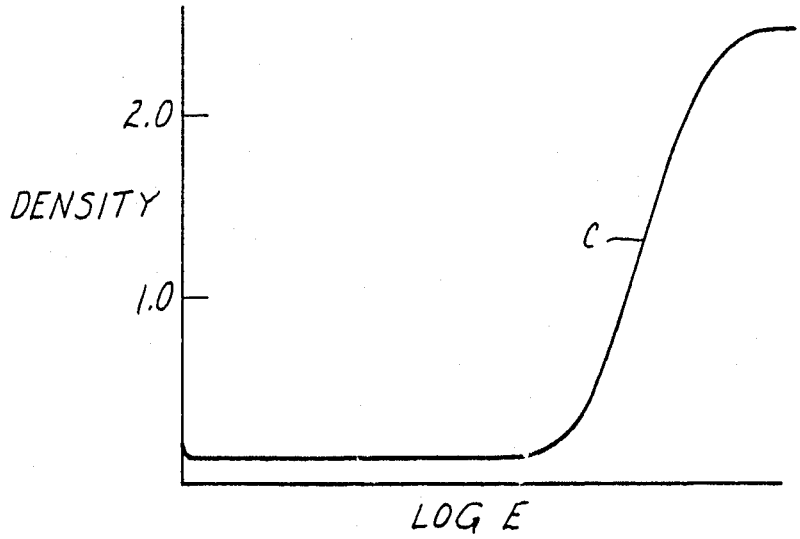

FIG. 1C shows the D vs logE curve for the photographic element of Example 1 when exposed to 890 nm radiation. Curve (c) shows the cyan-forming layer.

Figure 2:
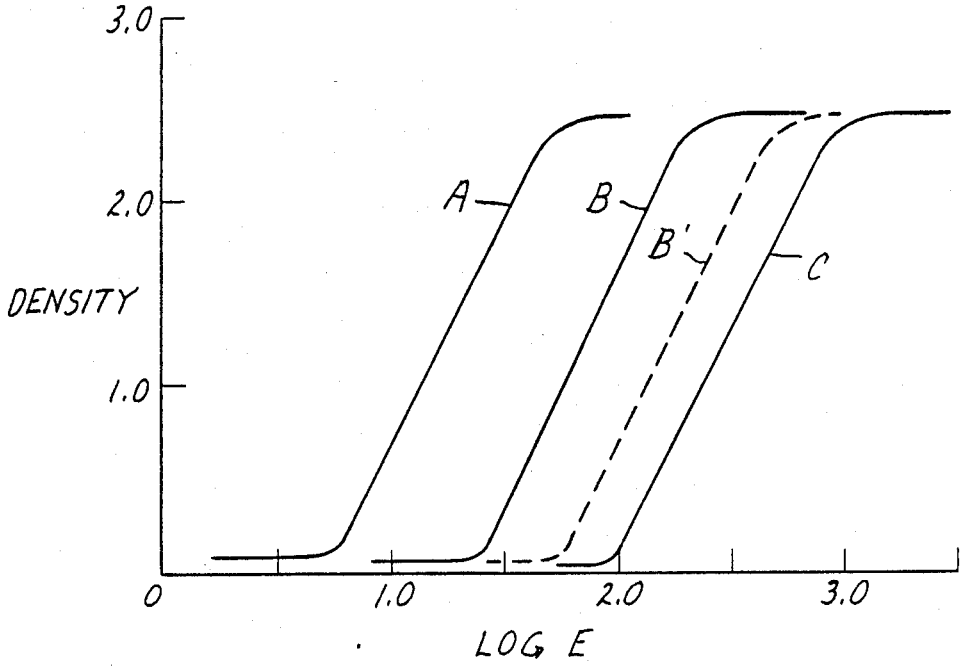
FIG. 2 shows the D vs logE curve for the photographic element of Example 2 after exposure to radiation having a wavelength of 780 nm.

FIG. 2 shows the D vs logE curve for the photographic element of Example 2 when exposed to 780 nm radiation. Curve A shows the yellow-forming layer. Curve B shows the magenta-forming layer in the element without a filter layer. Curve B′ shows the magenta-forming layer when a filter dye is present between layers 3 and 5. Curve C shows the cyan-forming layer. The shift in the D vs logE curve between Curves B and B′ is 0.38 Log E units.

DETAILED DESCRIPTION OF THE INVENTION

A photographic element is herein described which photographic element is capable of providing a full color image or three color images with exposure of at least two silver halide emulsion layers to radiation outside the visible region of the electromagnetic spectrum comprising:

(a) a substrate, and (b) on one side of said substrate at least three silver halide emulsion layers, each of said silver halide emulsion layers being associated with a means for forming a single color image of a different color dye, said three silver halide emulsion layers comprising in any order a first emulsion sensitized to a first portion of the infrared region of the electromagnetic spectrum, a second silver halide emulsion sensitized to a second portion of the infrared region of the electromagnetic spectrum, the wavelength of maximum spectral sensitivity of which second emulsion differs by at least 15 nm from the wavelength of maximum spectral sensitivity to which said first emulsion is sensitized, and a third silver halide emulsion sensitized to a third portion of the electromagnetic spectrum the wavelength of maximum spectral sensitivity of which portion differs by at least 15 nm from each of the wavelengths of maximum sensitivity to which said first and second emulsions are sensitized, the sensitivities of each of said three emulsion layers being such that between any two emulsion layers which are sensitized to portions of the infrared region of the electromagnetic spectrum, the emulsion having a wavelength of maximum spectral sensitivity which is the shorter of said two infrared sensitive layers has a speed at the wavelength of its maximum spectral sensitivity which is at least 0.2 logE units faster than the other of said two infrared sensitive layers. It has been found that with a difference in the wavelengths of at least 15 nm, the use of sensitivity differences alone at the wavelengths of maximum spectral sensitivity for each of the layers can provide color separation in the final image. This is particularly surprising because dyes which sensitize to the infrared, even those dyes capable of J-banding, tend to have long ranges of absorbance and hence sensitivity. For example, when a dye is chosen to sensitize an emulsion at 850 nm, it will also tend to sensitize with essentially equal effectiveness across the entire range of at least 800–850 nm. Thus, if two identical emulsions in the same photographic elements were sensitized with dyes having maximum spectral wavelengths of sensitivity at 800 nm and 850 nm, respectively, exposure to radiation of 800 nm would tend to equally expose both emulsions, thereby producing essentially no color separation.

Because of the small decrease in sensitivity effected by often large (e.g., 50 nm) movements towards shorter wavelengths within the regions of the electro-magnetic spectrum in which an infrared sensitizing dye will effectively sensitize, at least the 15 nm difference in the wavelengths of maximum spectral sensitivity desired. It is preferred that the difference between any two layers sensitive to the infrared be at least 20 nm, more preferred that the difference be at least 35 nm, and most preferred that the difference in wavelengths of maximum spectral sensitivity be at least 50 nm between any two layers sensitized to the infrared. The closer the wavelengths of maximum spectral sensitivity between layers, the greater should be the difference in sensitivities and the higher the contrasts. The use of filter layers between emulsion layers can help reduce the needed levels of sensitivity differences between layers. By using a filter dye between layers which absorbs strongly at the wavelengths of maximum spectral sensitivity of the uppermost emulsion layer (with respect to the direction from which exposure occurs), the needed difference in sensitivity of the lower layer can be somewhat reduced.

The preferred arrangement of layers has the wavelengths of maximum spectral sensitivity in the respective layers getting longer as one moves away from the direction (or surface) from which the exposure is to be made. That is, using for example, color paper or print as a reference, the infrared sensitive layer furthest from the paper base has a wavelength of maximum spectral sensitivity which is shorter than the wavelength of maximum spectral sensitivity of any other emulsion layer closer to the base. This preference is because sensitization peaks of dyes tend to fall off more quickly towards longer wavelengths making sensitivity separation more easily effected and filter dyes more easily chosen.

As previously described, when all three emulsion layers are within the infrared region of the electromagnetic spectrum, any two layers must have wavelengths of maximum spectral sensitivity differing by at least 15 mm and speed differences of at least 0.2 logE units. When two layers are sensitive to wavelengths within the infrared and the third is sensitized to a wavelength in the visible, such differential speed considerations should not be necessary with a reasonable selection of the wavelength of maximum sensitization. Spectral sensitizing dyes are available across the entire visible spectrum and even in to the ultraviolet. One of ordinary skill in the art could thus easily sensitize the third emulsion layer to a wavelength outside the infrared where there would be practically no overlap in spectral sensitization effected by the various sensitizing dyes. For example, the third emulsion layer could be sensitized more than 100 nm below the infrared (beginning approximately at about 750–780 nm) to the blue, green or yellow portions of the electromagnetic spectrum. If for any reason it were desired to have the third emulsion layer sensitized to a portion of the spectrum less than 100 nm from the shortest wavelength within the infrared to which an emulsion is sensitized, it would be desirable to give consideration to adjusting the speed of the emulsion sensitized to the visible in a manner similar to that done for shorter wavelengths within the infrared. If the emulsion layer sensitized to the visible portion of the electromagnetic spectrum is near to the infrared (e.g., within 50 nm of the shortest wavelength within the infrared to which an emulsion of the element has been spectrally sensitized), the speed of the emulsion sensitized to the visible should also be at least 0.2 or at least 0.5 logE units faster than the speed of the emulsion sensitized to a wavelength within the infrared nearest the visible portion of the spectrum. The use of spectral sensitizing dyes within the visible portion of the electromagnetic spectrum which form J-bands will effectively reduce the impact of this consideration. There should also be a difference of at least 15 nm between the wavelengths of maximum spectral sensitivity for layers within and without the infrared.

The speed of the emulsion layers is to be determined, at all times, at the wavelength of maximum spectral sensitivity for the emulsion layer. The term wavelength of maximum sensitivity should be read as wavelength of maximum spectral sensitivity in the practice of the present invention, that is, the wavelength of maximum sensitivity effected by the addition of spectral sensitizing dyes.

The broadest range of contrasts for use in construction of emulsions within the present invention is about 0.5 to 12. The lower limit is essentially a function of the power available from lasers in imaging apparatus. The upper limit tends to be a function of the type of use to which the film or paper is to be used. A range of 1 to 11 for contrast is preferred; a contrast of 2 to 8 is more preferred.

A photographic element is further herein described, which photographic element is capable of providing a full color image with exposure of at least two silver halide emulsion layers to radiation outside the visible region of the electromagnetic spectrum comprising (a) a substrate, and (b) on one side of said substrate at least three silver halide emulsion layers, each of said silver halide emulsion layers being associated with a means for forming a single color image of a different color dye, said three silver halide emulsion layers comprising a first emulsion sensitized to a portion of the infrared region of the electromagnetic spectrum, a second emulsion sensitized to a portion of the infrared region of the electromagnetic spectrum which is of a shorter wavelength than the portion to which said first emulsion is sensitized, and a third emulsion sensitized to a portion of the electromagnetic spectrum which is of a shorter wavelength than that portion to which said second emulsion is sensitized, and said three silver halide emulsion layers having a construction selected from the group consisting of:

(1) each of the three layers having a contrast between 0.5 and 12, preferably between 1 and 11, most preferably between 2 and 8, differing from each other in photographic speed such that, at an optical density of 1.3, the speed of the third emulsion (when sensitized to the infrared) is at least 0.2 logE units faster than the second emulsion layer, and the second emulsion is at least 0.2 logE units faster than the first emulsion layer, (2) between said first and second emulsion layers is a filter layer absorbing infrared radiation in a range overlapping the region of maximum sensitivity of said second emulsion layer without absorbing more than forty percent of the infrared radiation to which said first emulsion layer is sensitized, and when said third layer is also sensitized to the infrared region of the spectrum, between said second emulsion layer and said third emulsion layer is a filter layer absorbing radiation in a range overlapping the region of maximum sensitivity of said third emulsion layer without absorbing more than forty percent of the infrared radiation to which second layer is sensitized, and (3) directly between two layers comprising either said first and second emulsion layers or said second and third emulsion layers, when said third layer is also sensitized to the infrared region of the spectrum, a filter layer absorbing radiation in a range overlapping the region of maximum sensitivity of the one of the two layers farther away from the substrate without absorbing more than forty percent of the infrared radiation to which the other of said two layers is sensitized and the other pair of emulsion layers comprising said second and third emulsion layers and said first and second emulsion layers, respectively, having a contrast between 0.5 and 12, preferably between 1 and 11, most preferably between 2 and 8 and differing in speed from each other so that at an optical density of 1.3, the speed of the emulsion layer farthest from the substrate in said other pair of emulsion layers is at least 0.2 logE units faster than the speed of the emulsion layer closest to the substrate in said other pair of emulsion layers.

The higher the contrast in the emulsion layers in the practice of the present invention, the smaller need be the differences in speed. For example, with a contrast of 8 for the emulsion layers, a speed difference of 0.2 logE units at their wavelengths of maximum sensitivity would be sufficient. Below about 4.5 in contrast, the difference in speed must usually be at least 0.4 logE units, and with a contrast between about 2 and 4, the speed difference must usually be at least 0.5 logE units.

The relative order in the relationship of the emulsion layers of the present invention is important in obtaining benefits from the technology. The first layer, as described above, must be the emulsion layer farthest from the imaging radiation. Thus, where exposure would be through a transparent base, the first layer would be the emulsion layer farthest from the base, the top emulsion layer from a conventional perspective. Normally, photographic elements are not exposed through the base, and the first layer would normally be the infrared sensitized emulsion layer closest to the base.

As noted above, it is preferred that all of the silver halide emulsion layers are sensitized to different infrared regions of the electromagnetic spectrum. It is essential that at least two layers be sensitized to different infrared regions of the electromagnetic spectrum. The order of those at least two layers must still be that the emulsion layer sensitized to the longer wavelength is closest to the side of the photographic element first struck by the exposing radiation. There is more flexibility with respect to the placement of other silver halide emulsion layers which are sensitized to visible portions of the electromagnetic spectrum. For example, if a system were to be made which is composed of three emulsion layers sensitized to 800 nm and 880 nm and 580 nm (yellow), filter layers and reduced sensitivity of the emulsion layers would not be essential between the yellow layer and either of the infrared sensitive layers. The differential in sensitivity and/or filter layers would still have to exist between any two infrared sensitive layers. If the element were constructed with the emulsion layers (as counted towards the base) sensitized to (1) 580 nm, (2) 800 nm, and (3) 880 nm, the filter layer (if any), would have to be placed between layers (2) and (3) or the emulsion sensitivities must differ, as required in the practice of the present invention, only as between layers (2) and (3). Layer (1) would merely be constructed as a conventional yellow forming silver halide emulsion layer (or negative dye forming layer). If the yellow layer were placed in a construction between the two infrared sensitized layers, such as (1) 800 nm, (2) 580 nm, and (3) 880 nm, any filter layers must be between layers (1) and (3) and could be placed between layers (1) and (2) or between layers (2) and (3). The difference in emulsion sensitivity, if used, according to the practice of the present invention would be between layers (1) and (3). The sensitivity of layer (2) would be selected only on the basis of the activity desired to produce an effective yellow color. There are no significant considerations of guarding against exposure of layer 2 by radiation used to expose layers (1) or (3). Filters could be used if the dyes in layer (2) had a long tail on its absorption curve, but that would occur only with less than skillful selection of the yellow sensitizing dye.

If the visible light sensitive emulsion layer is used as the emulsion layer farthest from the base, similar considerations must be made. The filter layer would still have to be between the two infrared sensitive layers, if a filter layer is used. The difference in emulsion sensitivity must also be present between the two infrared sensitized layers if that method, according to the teachings of the present invention, is used.

The infrared portion of the electromagnetic spectrum is given various ranges, but is generally considered to be between 750 to 1500 nm which overlaps a small portion of the visible regions of the electromagnetic spectrum (e.g., about 750–780 nm). A large number of dyes are known to sensitize silver halide emulsions to various portions of the infrared region of the spectrum. In particular, cyanines and merocyanines are well documented as infrared sensitizers for various types of imaging systems including silver halide emulsions. For example, U.S. Pat. Nos. 2,104,064; 2,734,900; 2,895,955; 3,128,179; 3,619,154; 3,682,630; and 4,362,800 disclose many dyes which are sensitizers to the infrared. *Photographic Chemistry,* Vol. 2, P. Glafkides, 1960, Fountain Press, Chapter XL, pages 882–901 describes the spectral sensitization of silver halide emulsions to the infrared as does, more generally, *The Theory of the Photographic Process,* 3rd Ed., Mees and James, 1966, Chapter II, esp. pp. 199 and 205.

The following formulae represent examples of known infrared sensitizing dyes. These dyes are described in Mees and James, supra; Glafkides, supra; and U.S. Pat. No. 2,895,955.

In order that each emulsion is sensitized to respond to specific regions of the infrared spectrum, the sensitizing dyes chosen are extremely important to the construction of the color multilayer material. As shown in the following formulae, these dye structures are usually symmetrical or unsymmetrically substituted dicarbocyanines 1 and tricarbocyanines 2 with the auxochromic portions of the dyes being lepidine 3, quinoline 4, naphthothiazole 5, benzothiazole 6, and so forth. Heterocyclics may also be introduced into the methine chain to increase rigidity and stability of the dye molecule.

Some typical IR-sensitizing dyes 7–9 are shown in the following formulae. Each of these dyes was added to a silver chlorobromide emulsion coated and subsequently were exposed at various times with the emission from a tungsten-lamp source on a wedge spectrograph. The characteristic shape of their curves is a broad tail of sensitization stretching 150 to 300 nm from the peak of maximum sensitization to the shorter wavelength side of the spectrum, but a narrow tail of sensitization approximately 50 to 70 nm wide on the longer wavelength side. Other cyanine-type dyes 10–20 with various auxochromic end groups also exhibited similar sensitization curves on the emulsion. The wavelength of the peak of maximum sensitization (Peak) and the wavelength of the point at which minimum sensitization at longer wavelengths occur (Minimum) are shown. Any of the known useful anions may be associated with these compounds, but $I^-$, $Br^-$, tosylate, and para-toluene sulfonate are preferred.

These infrared sensitizing dyes, like most other sensitizing dyes do not have monochromatic absorption curves, but absorb, and thus sensitize to, a range of radiation wavelengths. Even J-banding dyes, which tend to have a narrower range of absorption for each dye, absorb over a range of the electromagnetic spectrum. This range can extend from a few nanometers up to a few hundred nanometers. Even though exposing radiation sources from lasers can be essentially monochromatic, the spectral sensitivities of even single layer emulsions may have maximum sensitivities at the wavelength of the exposing radiation, but still bracket that wavelength with a range of sensitivity.

State of the art infrared laser diodes tend to emit radiation between wavelengths of 750–950 nm. This tends to be too narrow a range to allow for multiple layer photographic emulsions with different regions of sensitivity. Sensitizing dyes selected to sensitize at about 780, 830, and 880, for example, would have sensitizing effects that could overlap the other wavelengths. Particularly in a photographic element intended to provide a full color image, an overlap in sensitizing ranges would cause poor faithfulness in color rendition because of the spurious imaging of multiple layers by the same wavelength of radiation. The constructions of the present invention enable manufacture of high quality color photographic images, even where the various emulsion layers are sensitized to maximize sensitivity at peaks within fifty nanometers of each other.

Any of the various types of photographic silver halide emulsions may be used in the practice of the present invention. Silver chloride, silver bromide, silver iodobromide, silver chlorobromide, silver chlorobromoiodide, and mixtures thereof may be used, for example. Any configuration of grains, cubic orthorhombic, hexagonal, epitaxial, or tabular (high aspect ratio) grains may be used. The couplers may be present either directly bound by a hydrophilic colloid or carried in a high temperature boiling organic solvent which is then dispersed within a hydrophilic colloid. The colloid may be partially hardened or fully hardened by any of the variously known photographic hardeners. Such hardeners are free aldehydes (U.S. Pat. No. 3,232,764), aldehyde releasing compounds (U.S. Pat. Nos. 2,870,013 and 3,819,608), s-triazines and diazines (U.S. Pat. Nos. 3,325,287 and 3,992,366), aziridines (U.S. Pat. No. 3,271,175), vinylsulfones (U.S. Pat. No. 3,490,911), carbodiimides, and the like may be used.

The silver halide photographic elements can be used to form dye images therein through the selective formation of dyes. The photographic elements described above for forming silver images can be used to form dye images by employing developers containing dye image formers, such as color couplers, as illustrated by U.K. Pat. No. 478,984, Yager et al. U.S. Pat. No. 3,113,864, Vittum et al. U.S. Pat. Nos. 3,002,836, 2,271,238 and 2,362,598. Schwan et al. U.S. Pat. No. 2,950,970, Carroll et al. U.S. Pat. No. 2,592,243, Porter et al. U.S. Pat. Nos. 2,343,703, 2,376,380 and 2,369,489, Spath U.K. Pat. No. 886,723 and U.S. Pat. No. 2,899,306, Tuite U.S. Pat. No. 3,152,896 and Mannes et al. U.S. Pat. Nos. 2,115,394, 2,252,718 and 2,108,602, and Pilato U.S. Pat. No. 3,547,650. In this form the developer contains a color-developing agent (e.g., a primary aromatic amine which in its oxidized form is capable of reacting with the coupler (coupling) to form the image dye. Also, instant self-developing diffusion transfer film can be used as well as photothermographic color film or paper using silver halide in catalytic proximity to reducable silver sources and leuco dyes.

The dye-forming couplers can be incorporated in the photographic elements, as illustrated by Schneider et al. *Die Chemie,* Vol. 57, 1944, p. 113, Mannes et al. U.S. Pat. No. 2,304,940, Martinez U.S. Pat. No. 2,269,158, Jelley et al. U.S. Pat. No. 2,322,027, Frolich et al. U.S. Pat. No. 2,376,679, Fierke et al. U.S. Pat. No. 2,801,171, Smith U.S. Pat. No. 3,748,141, Tong U.S. Pat. No. 2,772,163, Thirtle et al. U.S. Pat. No. 2,835,579, Sawdey et al. U.S. Pat. No. 2,533,514, Peterson U.S. Pat. No. 2,353,754, Seidel U.S. Pat. No. 3,409,435 and Chen Research Disclosure, Vol. 159, July 1977, Item 15930. The dye-forming couplers can be incorporated in different amounts to achieve differing photographic effects. For example, U.K. Pat. No. 923,045 and Kumai et al. U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al. U.S. Pat. Nos. 2,423,730, 2,772,162, 2,895,826, 2,710,803, 2,407,207, 3,737,316 and 2,367,531, Loria et al. U.S. Pat. Nos. 2,772,161, 2,600,788, 3,006,759, 3,214,437 and 3,253,924, McCrossen et al. U.S. Pat. No. 2,875,057, Bush et al. U.S. Pat. No. 2,908,573, Gledhill et al. U.S. Pat. No. 3,034,892, Weissberger et al. U.S. Pat. Nos. 2,474,293, 2,407,210, 3,062,653, 3,265,506 and 3,384,657, Porter et al. U.S. Pat. No. 2,343,703, Greenhalgh et al. U.S. Pat. No. 3,127,269, Feniak et al. U.S. Pat. No. 2,865,748, 2,933,391 and 2,865,751, Bailey et al. U.S. Pat. No. 3,725,067, Beavers et al. U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al. U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al. U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat. No. 3,222,176 and Canadian Pat. No. 726,651, Schulte et al. U.K. Pat. No. 1,248,924 and Whitmore et al. U.S. Pat. No. 3,227,550. Dye-forming couplers of differing reaction rates in single or separate layers can be employed to achieve desired effects for specific photographic applications.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated by Whitmore et al. U.S. Pat. No. 3,148,062, Barr et al. U.S. Pat. No. 3,227,554, Barr U.S. Pat. No. 3,733,201, Sawdey U.S. Pat. No. 3,617,291, Groet et al. U.S. Pat. No. 3,703,375, Abbott et al. U.S. Pat. No. 3,615,506, Weissberger et al. U.S. Pat. No. 3,265,506, Seymour U.S. Pat. No. 3,620,745, Marx et al. U.S. Pat. No. 3,632,345, Mader et al. U.S. Pat. No. 3,869,291, U.K. Pat. No. 1,201,110, Oishi et al. U.S. Pat. No. 3,642,485, Verbrugghe, U.K. Pat. No. 1,236,767, Fujiwhara et al. U.S. Pat. No. 3,770,436 and Matsuo et al. U.S. Pat. No. 3,808,945. Dye-forming couplers and nondye-forming compounds which upon coupling release a variety of photographically useful groups are described by Lau U.S. Pat. No. 4,248,962. DIR compounds which do not form dye upon reaction with oxidized color developing agents can be employed, as illustrated by Fujiwhara et al. German OLS No. 2,529,350 and U.S. Pat. Nos. 3,928,041, 3,958,993 and 3,961,959, Odenwalder et al. German OLS No. 2,448,063, Tanaka et al. German OLS No. 2,610,546, Kikuchi et al. U.S. Pat. No. 4,049,455 and Credner et al. U.S. Pat. No. 4,052,213. DIR compounds which oxidatively cleave can be employed, as illustrated by Porter et al. U.S. Pat. No. 3,379,529, Green et al. U.S. Pat. No. 3,043,690, Barr U.S. Pat. No. 3,364,022, Duennebier et al. U.S. Pat. No. 3,297,445 and Rees et al. U.S. Pat. No. 3,287,129. Silver halide emulsions which are relatively light insensitive, such as Lipmann emulsions, having been utilized as interlayers and overcoat layers to prevent or control the migration of development inhibitor fragments as described in Shiba et al. U.S. Pat. No. 3,892,572.

The photographic elements can incorporate colored dye-forming couplers, such as those employed to form integral masks for negative color images, as illustrated by Hanson U.S. Pat. No. 2,449,966, Glass et al. U.S. Pat. No. 2,521,908, Gledhill et al. U.S. Pat. No. 3,034,892, Loria U.S. Pat. No. 3,476,563, Lestina U.S. Pat. No. 3,519,429, Friedman U.S. Pat. No. 2,543,691, Puschel et al. U.S. Pat. No. 3,028,238, Menzel et al. U.S. Pat. No. 3,061,432 and Greenhalgh U.K. Pat. No. 1,035,959, and/or competing couplers, as illustrated by Murin et al. U.S. Pat. No. 3,876,428, Sakamoto et al. U.S. Pat. No. 3,580,722, Puschel U.S. Pat. No. 2,998,314, Whitmore U.S. Pat. No. 2,808,329, Salminen U.S. Pat. No. 2,742,832 and Weller et al. U.S. Pat. No. 2,689,793.

Particularly useful color couplers include the materials shown in the list of compounds as numbers 21–24.

As previously noted, the color provided in the image produced by exposure of each of the differently sensitized silver halide emulsion layers does not have to be produced by color coupler reaction with oxidized color developers. A number of other color image forming mechanisms well known in the art can also be used. Amongst the commercially available color image forming mechanisms are the diffusion transfer of dyes, dye-bleaching, and leuco dye oxidation. Each of these procedures is used in commercial products, is well understood by the ordinarily skilled photographic artisan, and is used with silver halide emulsions. Multicolor elements using these different technologies are also commercially available. Converting the existing commercially available systems to the practice of the present invention could be done by routine redesign of the sensitometric parameters of the system and/or the addition of intermediate filter layers according to the teachings of the present invention. For example, in a conventional instant color, dye transfer diffusion element, the sensitivity of the various layers and/or the arrangement of filters between the silver halide emulsion layers would be directed by the teachings of the present invention, the element otherwise remaining the same. This would be true with either negative-acting or positive-acting silver halide emulsions in the element. The only major, and fairly apparent, consideration that must be given to such a construction is to insure that the placement of any filter layers does not prevent transfer of the diffusion dye to a receptor layer within the element. Using a filter which is not a barrier layer between the receptor layer and the dye-containing layer is the simplest way to address that consideration. Such a layer should not prevent migration of the diffusion dye across the filter layer.

These types of imaging systems are well known in the art. Detailed discussions of various dye transfer, diffusion processes may be found for example in "A fundamentally New Imaging Technology for Instant Photography", W. T. Harison, Jr., Photographic Science and Engineering, Vol. 20, No. 4, July/August 1976, and Neblette's Handbook of Photography and Reprography, Materials, Processes and Systems, 7th Edition, John M. Stunge, van Nostrand Reinhold Company, N.Y., 1977, pp. 324–330 and 126. Detailed discussion of dye-bleach color imaging systems are found for example in *The Reproduction of Colour,* 3rd Ed., R. W. G. Hunt, Fountain Press, London, England 1975 pp. 325–330; and *The Theory of the Photographic Process,* 4th Ed., Mees and James, Macmillan Publishing Co., Inc., N.Y., 1977 pp. 363–366. Pages 366–372 of Mees and James, supra, also discuss dye-transfer processes in great detail. Leuco dye oxidation in silver halide systems are disclosed in such literature as U.S. Pat. Nos. 4,460,681, 4,374,821, and 4,021,240.

As previously noted, these existing color forming systems may be modified by the ordinarily skilled artisan according to the teachings of the present invention. For example, in the multilayer color photothermographic article of Example 1 of U.S. Pat. No. 4,460,681 the following steps would be taken to convert the element to the practice of the present invention. The sensitizing dye used to spectrally sensitize the first silver halide photothermographic emulsion would be replaced with the sensitizing dye used to sensitize the first emulsion layer of Example 1 of the present application. The filter layer described in Example 2 of the present application would be placed over all the coatings essential to the formation of color in the first deposited series of layers in Example 1 of U.S. Pat. No. 4,460,681. That filter layer could also function as the barrier layer required in the practice of that invention. The second series of layers essential for the formation of the next color according to U.S. Pat. No. 4,460,681 would then be deposited, the spectral sensitizing dye of that example being replaced by the spectral sensitizing dye of Example 1 of the present application. The remaining layers in the photothermographic element could then be the same as those described in the patent if light-sensitivity of the element (due to the light-sensitivity of the layers forming the third color) could be tolerated. If light-sensitivity is not desired, the second filter layer of Example 2 of the present application could be placed over the second color-forming layer of the photothermographic element. The third set of color forming layers of Example 1 of U.S. Pat. No. 4,460,681 would then be applied over the filter layer, and the sensitizing dye in that silver halide emulsion layer replaced with the spectral sensitizing dye of the top emulsion layer of Example 1 of the present application. Analogous substitution of sensitizing dyes, addition of filter layers, and/or modification of the relative sensitivities of silver halide layers in any of the other known color imaging processes could also be readily performed given the teachings of the present invention. Diffusion photothermographic color image forming systems such as those disclosed in U.K. Patent 3,100,458A are also useful in the practice of the present invention.

The photographic elements can include image dye stabilizers. Such image dye stabilizers are illustrated by U.K. Pat. No. 1,326,889, Lestina et al. U.S. Pat. Nos. 3,432,300 and 3,698,909, Stern et al. U.S. Pat. No. 3,574,627, Brannock et al. U.S. Pat. No. 3,573,050, Arai et al. U.S. Pat. No. 3,764,337 and Smith et al. U.S. Pat. No. 4,042,394.

Filter dyes are materials well known to the photographic chemist. The dyes where used, must be selected on the basis of their radiation filtering characteristics to insure that they filter the appropriate wavelengths. Filter dyes and their methods of incorporation into photographic elements are well documented in the literature such as U.S. Pat. Nos. 4,440,852; 3,671,648; 3,423,207; and 2,895,955; U.K. Patent No. 485,624, and *Research Disclosure,* Vol. 176, December 1978, Item 17643. Filter dyes can be used in the practice of the present invention to provide room-light handleability to the elements. Dyes which will not allow transmission of radiation having wavelengths shorter than the shortest wavelength to which one of the emulsion layers has been sensitized can be used in a layer above one or more (preferably all) of the emulsion layers. The cut-off filter dye preferably does not transmit light more than approximately 50 nm less than the shortest wavelength to which any of the emulsion layers have been sensitized. Filter dyes should also be provided with non-fugitive (i.e., non-migratory) characteristics and should be decolorizable (by bleaching in developer or heat, for example) or leachable (e.g., removed by solvent action of any baths).

Other conventional photographic addenda such as coating aids, antistatic agents, acutance dyes, antihalation dyes and layers, antifoggants, latent image stabilizers, antikinking agents, and the like may also be present.

Although not essential in the practice of the present invention, one particularly important class of additives which finds particular advantage in the practice of the present invention is high intensity reciprocity failure (HIRF) reducers. Amongst the many types of stabilizers for this purpose are chloropalladites and chloroplatinates (U.S. Pat. No. 2,566,263), iridium and/or rhodium salts (U.S. Pat. No. 2,566,263; 3,901,713), and cyanorhodates (Beck et al., J. Signalaufzeichnungsmaterialen, 1976, 4, 131).

EXAMPLE 1

A multi-layered IR-sensitive photographic color material was prepared by coating in order on resin-coated paper base the following layers:

The first layer: a gelatin chemically sulfur-sensitized silver chlorobromide emulsion (88 mol % Br, 4.2% Ag, and approximately 0.6 micron grain size) containing anti-foggants, speed enhancers, and cyan color-forming couplers 23 and 24 (prepared by standard methods described in U.S. Pat. No. 4,363,873) was sensitized to the 880 nm region of the spectrum with dye 9 in the quantity of $4.0\times10^{-4}$ mol per mol of silver and was coated so that the coating silver and cyan coupler weights are 346 mg per $m^2$, and 517 mg per $m^2$, respectively.

The second layer: A gelatin interlayer containing gel hardener, U.V. absorber, and antioxidant was coated so that the gelatin coating weights are 823 mg per $m^2$.

The third layer: as in the first layer, the same silver chlorobromide emulsion containing a magenta color-forming coupler 22 was sensitized to the 830 nm region of the spectrum with dye 8 in the quantity of $1.6\times10^{-4}$ mol per mol of silver and was coated so that the coating silver and magenta coupler weights are 402 mg per $m^2$ and 915 mg per $m^2$, respectively.

The fourth layer: a gelatin interlayer containing hardener, U.V. absorber, and antioxidant was coated so that the gelatin coating weight are 1.19 gram per $m^2$.

The fifth layer: the same gelatin silver chlorobromide emulsion as in the first layer containing a yellow color-forming coupler 21 was dye sensitized to the 780 nm region of the spectrum with 7 in the quantity of $5.9\times10^{-4}$ mol per mol of silver and was coated so that the coating silver and yellow coupler weights are 346 mg per $m^2$ and 474 mg per $m^2$, respectively.

The sixth layer: a gelatin interlayer containing hardener, U.V. absorber and antioxidant was coated so that the gelatin coating weight is 873 mg per $m^2$.

The seventh layer: a protective gelatin topcoat containing a hardener and surfactant was coated so that the gelatin coating weight is 1.03 g/$m^2$.

The construction described above was first exposed with light from a 2950 K tungsten lamp giving 2400 meterCandles (mC) illuminance at the filter plane for 0.1 sec through a 20 cm continuous type M carbon wedge (gradient: 0.20 density/cm), a Wratten red selective interference filter, and a 780 nm near infrared glass bandpass filter. Separate samples were then similarly exposed using a 830 nm or a 890 nm infrared filter. After exposure, these samples were processed in standard Kodak EP-2 processing color chemistry with conditions similar to those stated in U.S. Pat. No. 4,363,873.

After processing, status D densitometry was measured and the results are shown in Table 1. The corresponding D logE curves with the effects of secondary exposure removed are shown in FIG. 1. At the 780 nm exposure, the color separation was excellent and the change in speed between layers was 0.7 logE or greater. At the 830 nm exposure, no yellow color was observed and the separation between the 830 nm layer (magenta-color) and the 890 nm layer (cyan-color) was 0.65 logE in speed. Only the cyan color-forming layer was observed at the 890 nm exposure.

The results from the set of exposures for this color multilayer construction suggest that the incorporation of filter dyes within the interlayers is unnecessary.

TABLE 1

| | | Dmin | Dmax | SPD2[1] | AC[2] |
|---|---|---|---|---|---|
| 780 nm | Yellow | .11 | 2.32 | 3.58 | 2.46 |
| Exposed | Magenta | .11 | 2.26 | 2.70 | 2.62 |
| | Cyan | .14 | 1.12 | 2.01 | * |
| 830 nm | Yellow | * | * | * | * |
| Exposed | Magenta | .12 | 2.41 | 2.92 | 3.14 |
| | Cyan | .13 | 1.69 | 2.26 | 2.23 |
| 890 nm | Yellow | * | * | * | * |
| Exposed | Magenta | * | * | * | * |
| | Cyan | .13 | 2.47 | 2.77 | 3.00 |

[1]Relative speed measured at an absolute density of 0.075.
[2]The slope of the line joining the density points of 0.50 and 1.30 above base + fog.
*Not a measurable parameter.

EXAMPLE 2

A three-color IR-sensitive material may be prepared in the following manner by coating on a resin-coated paper substrate:

(1) A first layer consisting of a silver chlorobromide emulsion (4.2% Ag) containing antifoggants, speed enhancers, and a cyan color-forming coupler 23 sensitized to the 880 nm region of the spectrum with dye 9 at an approximate concentration of $3.0\text{–}6.0\times10^{-4}$ mol per mol of silver at approximate coupler and silver coating weights of 450 to 550 mg per $m^2$ and 250 to 450 mg per $m^2$, respectively.

(2) A second layer containing gelatin coated at approximately 0.8 to 1.2 g per $m^2$, U.V. absorber, antioxidant, gel hardener and filter dye of the type 25, 26, 27 or 28 which has been dispersed in oil similar to a dispersion method as described in U.S. Pat. No. 4,363,873 at concentrations such that absorbance of the coated dye ranges from 0.1 to 0.6 at 830 nm and minimum absorbance at 880 nm.

(3) A third layer containing a silver chlorobromide emulsion similar to the first layer sensitized to the 830 nm region of the spectrum with the dye 8 at an approximate concentration of $0.8\text{–}2.4\times10^{-4}$ mol per mol silver and coated at silver coating weights from 300 to 500 mg per $m^2$, various speed enhancers, antifoggants and a magenta-forming coupler 22 coated in amounts of 850 to 950 mg per $m^2$.

(4) A fourth layer similar to the gelatin interlayer of the second layer containing dyes of the type 25, 26, 27 or 28 dispersed in oil and coated in the gelatin such that the absorbance at 780 nm ranges from 0.1 to 0.6 and minimum absorbance is observed at 830 and 880 nm.

(5) A silver chlorobromide emulsion fifth layer similar to the first layer containing a yellow color-forming coupler 21 and dye sensitized to the 780 nm region of the spectrum with 7 in the quantity of $3.0\text{–}7.0\times10^{-4}$ mol per mol silver and coated so that the silver and yellow coupler coating weights vary from 250 to 450 mg per $m^2$ and 425 to 525 mg per $m^2$, respectively.

(6) A sixth layer containing gelatin as an interlayer so that the gelatin coating weight varies from 0.8 to 1.2 g per $m^2$, U.V. absorber, and an antioxidant.

(7) A seventh layer as a protective gelatin topcoat containing a gel hardener and surfactant coated so that the gelatin coating weight becomes 0.9 to 1.1 g per $m^2$.

The filter dyes described in this example (supra) will meet the stated requirements of decoloration during photographic development, non-diffusion through the layer to adjoining layers and the required spectral absorption characteristics.

The above described construction when exposed with a tungsten lamp sensitometer giving 2400 mc illuminance at the filter plane for 0.1 sec. through a 20 cm continuous wedge (gradient: 0.20 density/cm), a Wratten red selective filter, and a 780 nm near infrared glass bandpass filter may have D logE curves similar to those shown in FIG. 2. There is some overlap of D logE curves for layer 5 and layer 3 when no filter dye is present in layer 4 (shown with solid line) and therefore, no pure color separation would be observed after exposure. However, after the incorporation of a filter dye in layer 4 with 0.4 absorbance at 780 nm, the effect on the D logE curve of layer 3 is shown by the dashed line and the full density of color would be achieved in layer 5 before exposure of layer 3.

The same effects may be observed for exposure of the material with the tungsten sensitometer as described above but containing a 830 nm narrow bandpass filter. If no filter dye is present in layer 2 than overlap of D logE curves are observed. However, after the incorporation of a filter dye in layer 2 with 0.4 absorbance at 830 nm, the effect on layer 1 is shown by the dashed line of the D logE curve and thus, the full density of color for layer 3 would be achieved before exposure of layer 1.

EXAMPLE 3

As an alternative to the above color multilayer construction, the need for the 830 nm absorbing filter dye in layer 2 may become unnecessary if the speed of the emulsion layers 1 and 3 are manipulated properly as described below:

(1) The first layer, as described in Example 1, containing a silver chlorobromide emulsion sensitized to 880 nm with dye 9 in the quantity of $4.0\times10^{-4}$ mol per mol silver and a cyan-forming coupler 23 coated on a substrate such that the silver and coupler coating weights are 346 mg per $m^2$ and 517 mg per $m^2$, respectively.

(2) The second layer: a gelatin interlayer containing gel hardener, U.V absorber, and antioxidant coated such that the gelatin coating weight becomes 823 mg per $m^2$.

(3) The third through seventh layers: all are same in construction to those described in Example 2.

The multilayer color material when exposed with the 780 and 830 nm filters of the tungsten sensitometer, as described in Example 2, would have D logE curves similar to those in FIG. 2. At the 780 nm exposure, overlap of D logE curves for Layer 5 and Layer 3 occurs without a filter dye present in Layer 4 (solid lines) and after the incorporation of the dye in Layer 4, pure color separation with the 780 nm exposure is achieved as shown by the dashed line for Layer 3. However, after exposure the 830 nm filter, full density of color for Layer 3 is achieved before any exposure of Layer 1 negates the need for a filter dye in Layer 2. Good color separation was achieved because of the accurate speed manipulation of both these layers.

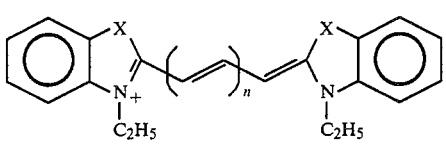

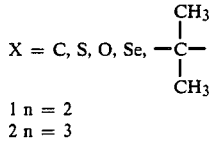

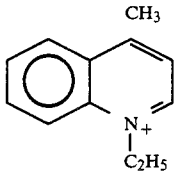

3

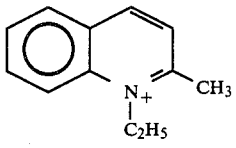

4

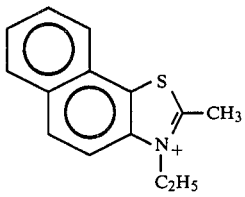

5

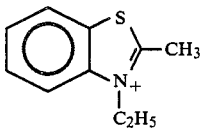

6

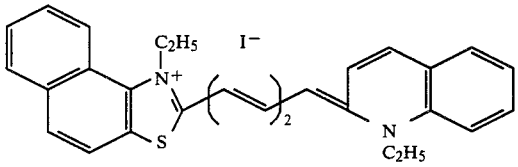

7

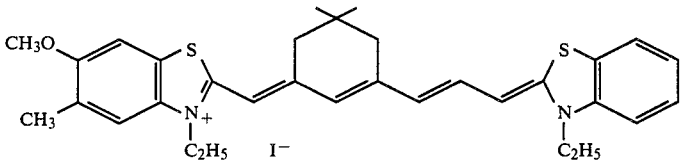

8

-continued
| | | Peak (nm) | Minimum (nm) |
|---|---|---|---|
| 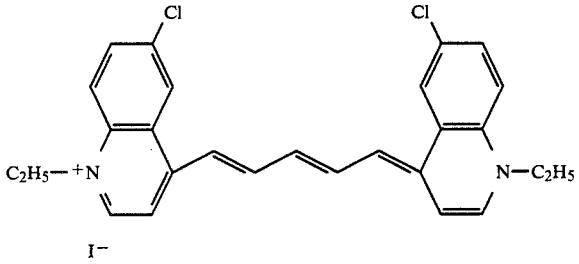 | 9 | | |
| 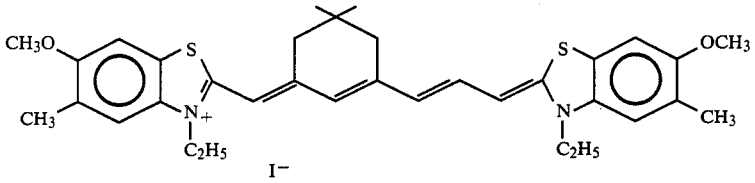 | 10 | 830 | 875 |
| 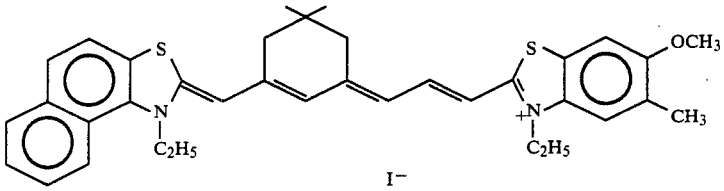 | 11 | 850 | 925 |
| 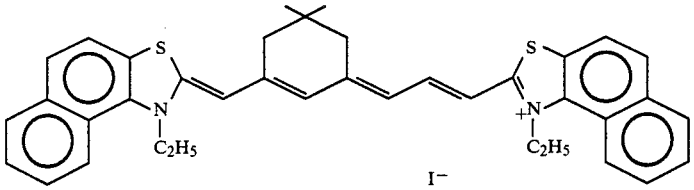 | 12 | 860 | 935 |
| 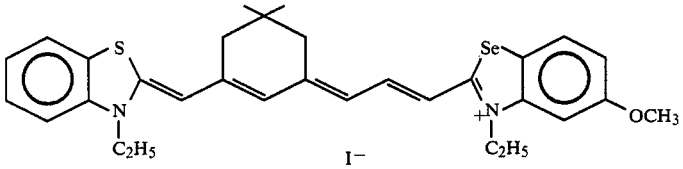 | 13 | 825 | 890 |
| 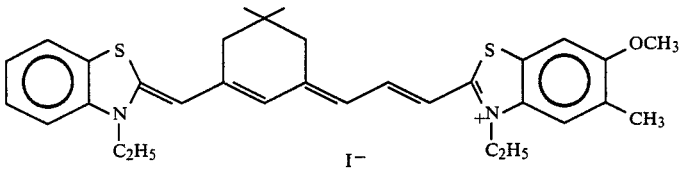 | 14 | 830 | 880 |
| 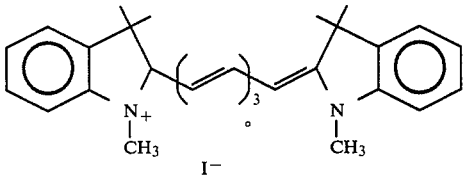 | 15 | 795 | 825 |
| 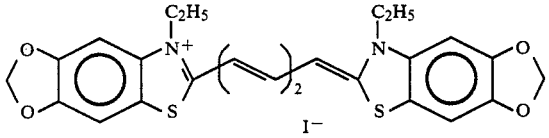 | 16 | 735 | 800 |

-continued
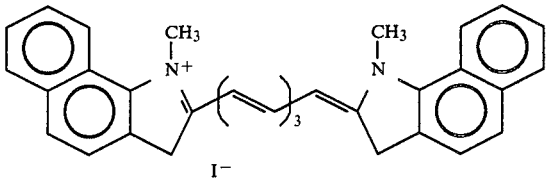
17 835 870
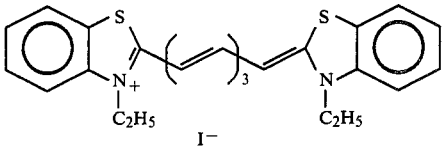
18 820 893
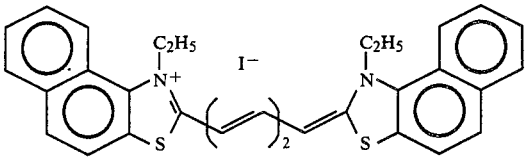
19 740 800
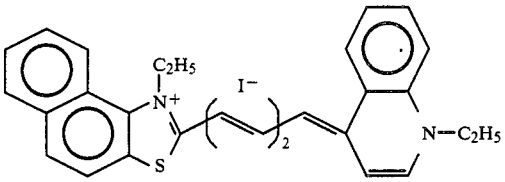
20 827 880
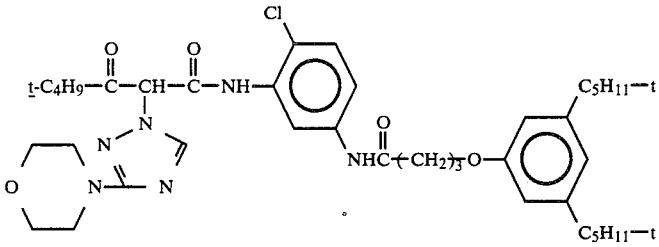
21
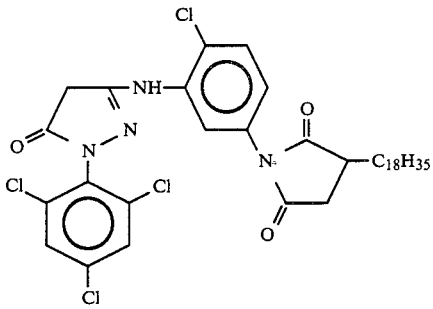
22
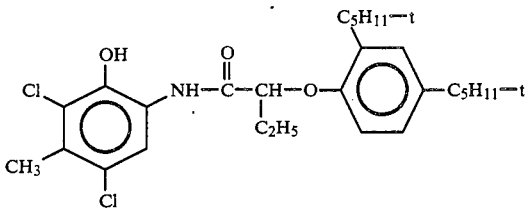
23

-continued

| | | |
|---|---|---|
| 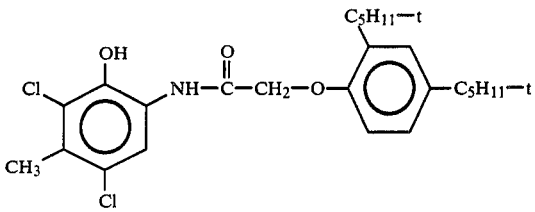 | 24 | |
| 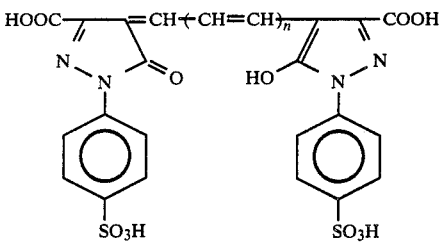 | 25 | n = 3,4 |
| 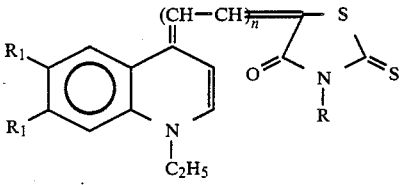 | 26 | n = 3,4<br>R = $C_2H_5$, $CH_2COOH$<br>$R_1$ = $C_2H_4SO_3H$, $CH_3$, H |
| 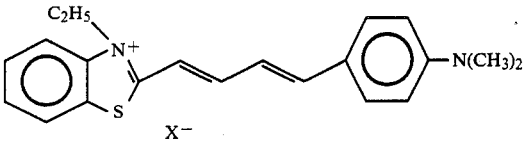 | 27 | X = Br, I |
| 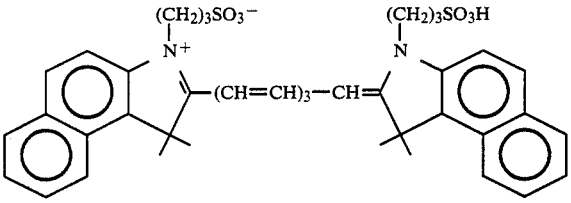 | 28 | |

EXAMPLE 4

Two diffusion transfer type constructions of two different colors was made as follows to show their utility according to the present invention.

Coating 1

A photographic element was prepared by coating sequentially the following three layers onto a subbed polyester film support.

(a) A first layer consisting of yellow dye developer of structure A dispersed in gelatin. The coverage of dye was 5 mg/dm$^2$ and that of gelatin was 7.2 mg/dm$^2$.

(b) A second layer consisting of a silver chlorobromide emulsion (36:64; Br:Cl) of 0.3 micron average grain size sensitized to 780 nm radiation by the addition of dye of structure B ($3\times10^{-4}$ moles dye/mole silver). The silver coverage was 5 mg/dm$^2$.

(c) A third layer consisting of 1-phenyl-5-pyrazolidinone (2.2 mg/dm$^2$) dispersed in gelatin (145 mg/dm$^2$).

Coating 2

Coating 2 was identical with Coating 1 except that a magenta dye developer of structure C replaced the yellow dye developer in the first layer and the silver halide emulsion was sensitized not to 780 nm but to 830 nm radiation by the addition of a sensitizing dye of structure D ($5\times10^{-5}$ moles dye per mole silver).

Evaluation

Five samples taken from Coating 1 were separately exposed in a sensitometer to radiation from a 500 watt tungsten filament lamp attenuated by a 0–4 continuous neutral density wedge and filtered by 730 nm, 760 nm, 790 nm, 820 nm, 850 nm or 880 nm narrow bandpass interference filters.

The samples were laminated to Agfa-Gervaert "Copycolor CCF" dye receptor sheets using an Agfa-Gevaert "CP 380" color diffusion transfer processing machine containing 2% aqueous potassium hydroxide as processing solution. The receptor sheets were separated after one minute.

Coating 1 showed a maximum sensitivity at 760 nm resulting in a positive yellow image on the receptor sheet. Coating 1 exhibited no measurable sensitivity at 820 nm or longer wavelengths.

This test procedure was repeated with Coating 2. In this case a sensitivity maximum at 820 nm was observed resulting in a positive magenta image. Coating 2 was 0.57 reciprocal Log exposure units less sensitive at 760 nm than at 820 nm and 1.70 reciprocal Log exposure units less sensitive at 880 nm than at 820 nm.

These layers if used in presently commercial diffusion transfer elements would properly function according to the teachings of the present invention.

STRUCTURE A

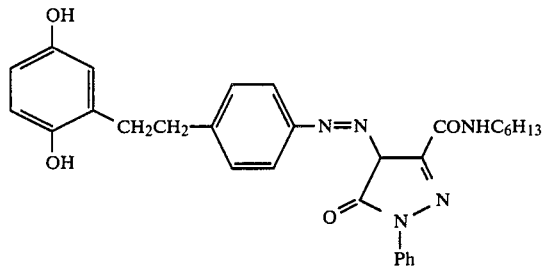

STRUCTURE B

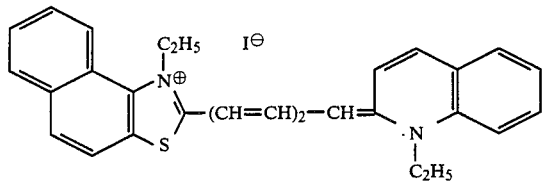

STRUCTURE C

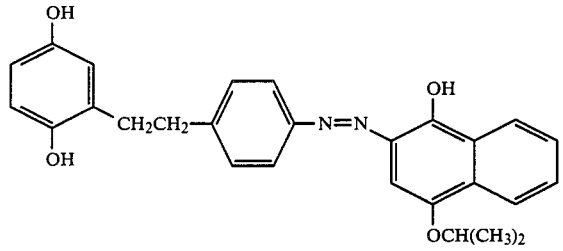

STRUCTURE D

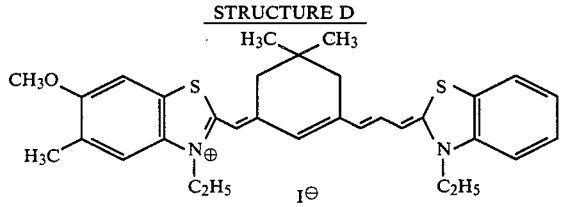

EXAMPLE 5

A single-color Infrared-sensitive photographic material was prepared by coating in order on resin-coated paper base the following layers:

(1) A first-layer consisting of a chemically sensitized silver chlorobromide emulsion (6.8% Ag) containing antifoggants, speed enhancers and the magenta color forming coupler 22. The emulsion was sensitized to the 830 nm region of the spectrum with dye 8 at a dye concentration of $1.1\times10^{-4}$ mol percent mol of silver at coupler and silver coating weights of 1.12 g/m$^2$ and 503 mg/m$^2$, respectively;

(2) A second layer containing gelatin coated at 1.20 g/m$^2$, U.V. absorber, antioxidant, gel hardener and the filter dye 29, which was dissolved in methanol, were added to the gelation mixture and coated such that the filter dye coating weight was 15.1 mg/m$^2$;

(3) A third layer (as a protective gelatin topcoat) contained a gel hardener and surfactant coated such that the gelatin coating weight was 1.04 g/m$^2$.

EXAMPLE 6

A single-color Infrared-sensitive material was prepared as described in Example 5; however, dye 8 was added as a filter dye and coated so that the filter dye coating weight was 15.1 mg/m$^2$ in the second layer.

EXAMPLE 7

A single-color Infrared-sensitive material was prepared as described in Example 5; however, no filter dye was incorporated into the second layer (control). In all examples the materials were exposed with a tungsten lamp sensitometer giving 2400 mc illuminance at the filter plane for 0.1 seconds through a 20 cm continuous wedge (gradient: 0.20 density per cm), a Wratten red selective filter and a 830 nm near infrared, glass, bandpass filter. After exposure, these samples were processed in standard Kodak E-2 processing color chemistry with conditions similar to those stated in U.S. Pat. No. 4,363,873.

After processing, status D densitometry was measured and the results are shown in Table 1. The gel interlayers containing the filter dyes of Example 5 and 6 were also spread by hand onto polyethylene terephthalate, allowed to dry and the absorption characteristics measured on a Perkin-Elmer absorption spectrophotometer. These results showed that dye 29 of Example 5 has a peak of maximum sensitization at 810 nm and a secondary peak at 705 nm with residual absorption from 580 nm to 900 nm. The filter dye used in Example 6 has a peak of maximum sensitization at 780 nm and a secondary absorption at 700 nm with broad residual absorption from 520 nm to 880 nm.

The results suggest that photographic speed of an emulsion layer can be manipulated by incorporating an infrared-absorbing dye in the gel layer above the infrared-sensitized emulsion. These filter dyes, though not fully processable as indicated by the higher $D_{min}$ for Examples 5 and 6, decreased the photographis speed of the emulsion by approximately 0.5 log E vs. the control Example 7).

9

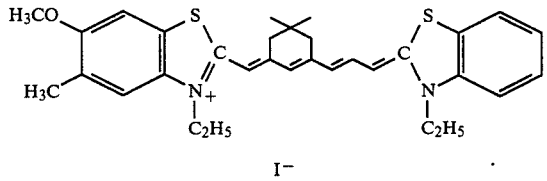

29

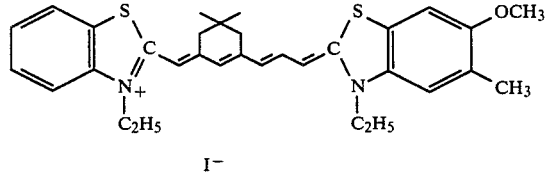

-continued

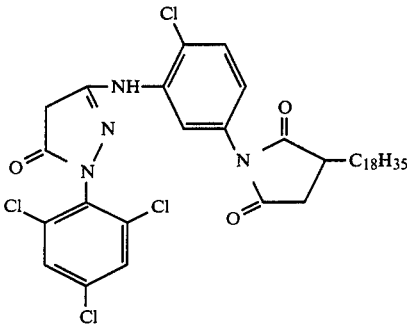

TABLE 2

| | Dmin | Dmax | SPD2[1] | AC[2] |
|---|---|---|---|---|
| Example 5 | 0.33 | 1.92 | 3.45 | 1.82 |
| Example 6 | 0.30 | 1.85 | 3.55 | 1.56 |
| Example 7 (control) | 0.18 | 2.23 | 3.97 | 2.27 |

[1]Relative speed measured at an absolute density of 0.75.
[2]The slope of the line joining the density points of 0.50 and 1.30 above base + fog.

EXAMPLE 8

A full-color Infrared-sensitive material was prepared by coating in order on resin-coated paper base the following layers:

The first layer: a gelatin chemically sensitized silver chlorobromide emulsion (6.7% Ag) containing anti-foggants, speed enhancers, and cyan color-forming coupler 23 was sensitized to the 880 nm region of the spectrum with dye 9 in the quantity of $1.6\times10^4$ mol per mol of silver and was coated so that the coating silver and cyan coupler weights were 412 mg/m$^2$ and 634 mg/m$^2$, respectively.

The second layer: a gelatin interlayer containing gel hardener, U.V. absorber, and antioxidant was coated so that the gelatin coating weight was 828 mg/m$^2$.

The third layer: a gelatin chemically sensitized silver chlorobromide emulsion (6.6% Ag) containing anti-foggants, speed enhancers, and magenta color-forming coupler 22 was sensitized to the 830 nm region of the spectrum with dye 8 in the quantity of $8.9\times10^{-5}$ mol per mol of silver and was coated so that the coating silver and magenta coupler weights were 492 mg/m$^2$ and 1.12 g/m$^2$, respectively.

The fourth layer: a gelatin interlayer containing hardener, U.V. absorber, antioxidant and the filter dye 29, which has been dissolved in methanol and added to the gelatin mixture, was coated such that the filter dye and gelatin coating weights were 8.3 mg/m$^2$ and 0.65 g/m$^2$, respectively.

The fifth layer: a gelatin chemically sensitized silver chlorobromide emulsion (6.7% Ag) containing antifoggants, speed enhancers, and yellow color-forming coupler 21 was dye sensitized to the 780 nm region of the spectrum with dye 7 in the quantity of $3.4\times10^{-4}$ mol per mol of silver and was coated so that the coating silver and yellow coupler weights were 497 mg/m$^2$ and 679 mg/m$^2$, respectively.

The sixth layer: a gelatin interlayer containing hardener, U.V. absorber, and antioxidant was coated so that the gelatin coating weight was 876 mg/m$^2$.

The seventh layer: a protective gelatin top-coat containing a hardener and surfactant was coated so that the gelatin coating weight was 1.04 g/m$^2$.

EXAMPLE 9

A multi-color Infrared-sensitive material was prepared as described in Example 8; however, dye 8 was added as a filter dye and coated so that the filter dye coating weight was 8.3 mg/m$^2$ in the fourth layer.

EXAMPLE 10

A multi-color Infrared-sensitive material was prepared as described in Example 8; however, no filter dye was incorporated into the fourth layer (control) and the gel coating weight was 1.20 g/m$^2$.

In examples 8–10, all materials were exposed to a tungsten sensitiometer as described in Example 5–7, except separate samples were then similarly exposed using a 780 nm or a 890 nm infrared filter.

The sensitometric results are shown in Table 1. The filter dye gel interlayer (layer 4) from examples 8 and 9 were hand-spread onto polyethylene terephthalate as desribed above. The absorption curves suggest that absorption of 780 nm and 830 nm light would be similar for the dye interlayer of example 8 and that less absorption of the 830 nm light vs. 780 nm light would be observed for the dye interlayer of example 9. The sensitometric results for the multi-layer material of these examples also suggests this observation. At the 780 nm exposure, the loss in speed for layer 3 (magenta color) relative to the non-filtered layer 3 of example 10 (control) is approximately 0.25 logE and 0.36 logE for example 9 and 8, respectively. At the 830 nm exposure, the loss in speed for layer 3 vs. the control (example 10) was minimal for example 9 (less dye interlayer filtering) vs. example 8 (0.9 logE vs. 0.27 logE).

Also, loss in photographic speed is observed for layer 5 (yellow-color, 780 nm sensitized of examples 8 and 9) vs. the non-filter dye interlayer of example 10 (control) at the 780 nm exposure even though the absorption of 780 nm light occurs in layer 4 after the initial non-filtered 780 nm exposure of layer 5. These results suggest that for the non-filtered material of example 10 the 780 nm light passes through all layers, reaches the base and then is reflected back through all layers so that each layer of the photographic material is exposed twice. With the incorporation of the filter dyes into layer 4, the first pass of 780 nm light through the multilayer materials of example 8 and 9 is non-filtered for layer 5 (780 nm sensitized) so that the first exposure occurs, then as the residual 780 nm light passes through layer 4, some of the light is absorbed. After this filtration, the remaining 780 nm light then continues through the layers, reaches the base, and is reflected back through the layers until more of this light is absorbed or filtered again (effective double filtration) while passing through layer 4 (filter layer) to reexpose the 780 nm layer (layer 5). Thus, the total amount of effective 780 nm exposure will be less for multilayer materials containing the filter dye interlayers vs. non-filter dye interlayer constructions and therefore, the observed speed of the 780 nm sensitized (layer 5) will be less because of this total lower amount of exposure.

The results from the set of exposures for the color multilayer constructions of example 8–10 suggest that the incorporating of filter dyes can effectively manipulate the photographic speeds of emulsion layers.

23

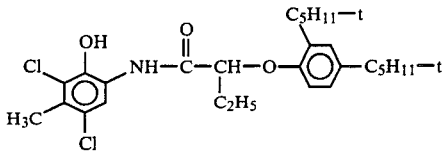

9

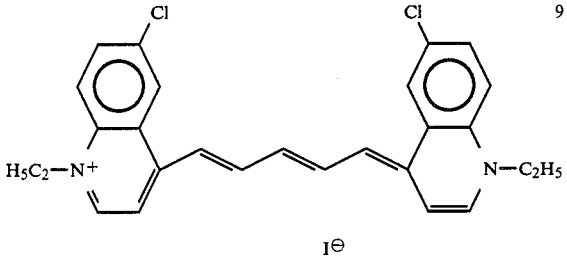

21

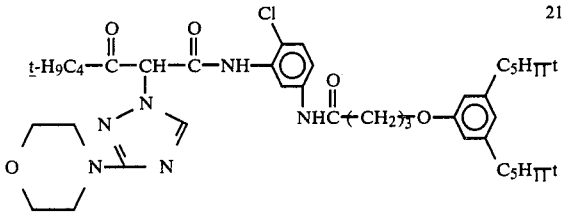

7

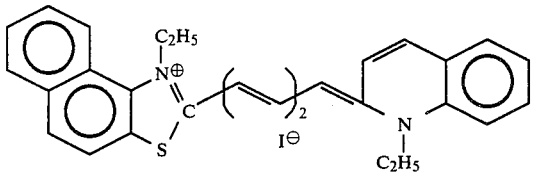

TABLE 3

| | | Dmin | Dmax | SPD2[1] | AC[2] |
|---|---|---|---|---|---|
| 780 nm Exposure | | | | | |
| Example 8 | yellow | .20 | 2.28 | 5.68 | 2.70 |
| | magenta | .19 | 1.85 | 4.89 | 1.93 |
| Example 9 | yellow | .19 | 2.25 | 5.79 | 2.80 |
| | magenta | .18 | 1.99 | 5.00 | 2.00 |
| Example 10 | yellow | .13 | 2.25 | 6.03 | 2.78 |
| | magenta | .14 | 2.16 | 5.25 | 2.17 |
| 830 nm Exposure | | | | | |
| Example 8 | magenta | .20 | 2.13 | 3.22 | 2.27 |
| | cyan | .31 | * | * | * |
| Example 9 | magenta | .18 | 2.23 | 3.40 | 2.27 |
| | cyan | .25 | * | * | * |
| Example 10 | magenta | .13 | 2.22 | 3.49 | 2.27 |
| | cyan | .15 | * | * | * |
| 890 nm Exposure | | | | | |
| Example 8 | cyan | 0.30 | .68[3] | * | * |
| Example 9 | cyan | 0.24 | .71[3] | 2.54 | * |
| Example 10 | cyan | .15 | .80[3] | 2.58 | * |

[1]Relative speed measured at an absolute density of 0.75
[2]The slope of the line joining the density points of 0.50 and 1.30 above base + fog.
[3]Number does not reflect absolute maximum density of layer but limit of exposure at designated exposure conditions.
*Parameter not measurable

EXAMPLE 11

A multi-layered IR-sensitive photographic color material was prepared by coating in order on resin-coated paper base the following layers:

The first layer: A gelatin/chemical sensitized silver chlorobromide emulsion (88 mol %, Br, 6.7% Ag, and approximately 1.0 micron grain size) containing antifoggants, speed enhancers, and the cyan color-forming coupler 23 was sensitized to the 880 nm region of the spectrum with dye 9 in the quantity of $1.6\times10^{-4}$ mol per mol of silver. The emulsion was coated so that the silver and coupler coating weights were 417 mg per $m^2$ and 636 mg per $m^2$, respectively.

The second layer: A gelatin interlayer containing gelatin hardener, U.V. absorber, and antioxidant was coated so that the gelatin coating weight was 828 mg per $m^2$.

The third layer: A gelatin/chemically sensitized silver chlorobromide emulsion (88 mol % Br, 6.7% Ag, and approximately 0.5 micron grain size) containing anti-foggants, speed enhancers, and the magenta color-forming coupler 22 was sensitized to the 830 nm region of the spectrum with dye 8 in the quantity of $8.8\times10^{-5}$ mol per mol silver. This was coated so that the silver and coupler coating weights were 492 mg per $m^2$ and 1.12 g per $m^2$, respectively.

The fourth layer: A gelatin interlayer containing hardener, U.V. absorber, and antioxidant was coated so that the gelatin coating weight was 1.20 g per $m^2$.

The fifth layer: The same gelatin silver chlorobromide emulsion as in the first layer, containing the yellow color-forming coupler 21, was dye sensitized to the 780 nm region of the spectrum with dye 7 in the quantity of $3.4\times10^{-4}$ mol per mol silver. This was coated so that the silver and coupler coating weights were 542 mg per $m^2$ and 748 mg per $m^2$, respectively.

The sixth layer: A gelatin interlayer containing hardener, U.V. absorber and antioxidant was coated so that the gelatin coating weight was 876 mg per $m^2$.

The seventh layer: A protective gelatin topcoat containing a hardener and surfactant was coated so that the gelatin coating weight was 1.04 g per $m^2$.

EXAMPLE 12

A multi-layered IR-sensitive photographic material was prepared as described in Example 11, except that the 780 nm sensitized layer (fifth layer) was coated as the third layer and the 830 nm sensitized layer (third layer) was coated as the fifth layer.

EXAMPLE 13

A multi layered IR-sensitive photographic material was prepared as described in Example 11, except that the 780 nm sensitized layer (fifth layer) was coated as the first layer and the 880 nm sensitized layer (first layer) was coated as the fifth layer.

The constructions described above were first exposed with the output from a 780 nm 2 mw laser diode sensitometer. The sensitometer is capable of writing laser raster exposures onto film strips through a circular wedge, neutral-density filter (metal vacuum-deposited, 0–4 neutral density). Separate samples were then similarly exposed using a 820 nm or a 880 nm laser diode source in the sensitometer. After exposure, these samples were processed in standard Kodak EP-2 processing color chemistry.

After processing, status D densitometry was measured and the corresponding D logE curves were produced. These results show that full yellow color density can be achieved for the 780 nm sensitized layers of Examples 11–13 before the required exposure images the slower (in speed) 830 nm sensitized emulsion layer. Also, the results show that regardless of placement (layer 1, for Example 13, layer 3 for Example 12, and layer 5 for Example 11) within the multi-layer construction. Unique color separation was achieved between the 780 and 830 nm sensitized layers. With 820 nm laser exposure, a magenta color density of 2.0 is achieved for Examples 11 and 12 before exposure images the slower (in speed) 880 nm sensitized emulsion layer. This unique color separation would also be attained if the 880 nm sensitized layer (layer 5) of Example 13 was slowed down in speed further. Surprisingly, regardless of placement of the 830 and 880 nm sensitized layers within the construction, color separation was achieved. With the 880 nm exposure, only the 880 nm sensitized layers of Examples 11–13 are exposed regardless of placement within the construction. The results from these examples show that if sufficient speed separation (780 nm layer faster in speed that the 830 nm layer, the 830 nm layer faster in speed than the 880 nm layer) is maintained between the emulsion layers, then unique color separation is achieved.

We claim:

1. A photographic element capable of providing a full color image without exposure to radiation within the visible region of the electromagnetic spectrum comprising (a) a substrate, and (b) on one side of said substrate at least three silver halide emulsion layers, each of said silver halide emulsion layers being associated with a different color photographic coupler, each of said couplers being capable of forming a different color dye upon reaction with an oxidized color photographic developer, said three silver halide emulsion layers comprising, in order from the substrate to the surface of said photographic element, a first emulsion sensitized to a portion of the infrared region of the electromagnetic spectrum, a second emulsion sensitized to a portion of the infrared region of the electromagnetic spectrum which is of a shorter wavelength than the portion to which said first emulsion is sensitized, and a third emulsion sensitized to a portion of the infrared region of the electromagnetic spectrum which is of a shorter wavelength than the portion to which said second emulsion is sensitized, and said three silver halide emulsion layers having a construction selected from the group consisting of:

(1) each of the three layers having a contrast between 0.5 and 12 and differing from each other in photographic speed such that, at an optical density of 1.3, the speed of the third emulsion is at least 0.2 logE units faster than the second emulsion layer, and the second emulsion is at least 0.2 logE units faster than the first emulsion layer, (2) between said first and second emulsion layers is a filter layer absorbing infrared radiation in a range overlapping the region of maximum sensitivity of said second emulsion layer without absorbing more than forty percent of the infrared radiation to which said first emulsion layer is sensitized, and between said second emulsion layer and said third emulsion layer is a filter layer absorbing radiation in a range overlapping the region of maximum sensitivity of said third emulsion layer without absorbing more than forty percent of the infrared radiation to which said second layer is sensitized, and (3) directly between two layers comprising either said first and second emulsion layers or said second and third emulsion layers a filter layer absorbing radiation in a range overlapping the region of maximum sensitivity the one of the two layers further away from the substrate without absorbing more than forty percent of the infrared radiation to which the other of said two layers is sensitized and the other pair of emulsion layers comprising said second and third emulsion layers and said first and second emulsion layers, respectively, having a contrast between 0.5 and 12 and differing in speed from each other so that at an optical density of 1.3, the speed of the emulsion layer farthest from the substrate in said other pair of emulsion layers is at least 0.2 logE units faster than the speed of the emulsion layer closest to the substrate in said other pair of emulsion layers.

2. The photographic element of claim 1 in which the contrast of each of said at least three silver halide emulsion layers is between 2 and 8.

3. The photographic element of claim 2 in which the construction has at least one filter layer between a pair of adjacent emulsion layers which absorbs between ten and eighty percent of the infrared radiation to which the layer farther from the substrate is sensitized while absorbing less than forty percent of the infrared radiation to which the layer closer to the substrate is sensitized.

4. The photographic element of claim 2 in which two filter layers are present, one between said first and a second emulsion layer and one between said second and third emulsion layer, each of said filter layers absorbing at least ten and less than eighty percent of the infrared radiation to which the adjacent layer farther from the substrate is sensitized while absorbing less than twenty-five percent of the infrared radiation to which the adjacent layer closer to the substrate is sensitized.

5. The photographic element of claim 2 in which at least two adjacent emulsion layers differ in their photographic speed and have a contrast between 2 and 5, the speed difference between said two adjacent layers being such that at an optical density of 1.3 the speed of the adjacent emulsion layer closest to the substrate is at least 0.5 logE units slower than the speed of the adjacent emulsion layer farthest from the substrate.

6. The photographic element of claim 2 in which both pairs of adjacent emulsion layers in a three emulsion layer system differ in their photographic speed and have a contrast between 2 and 5, the speed difference between adjacent layers being such that at an optical density of 1.3 the speed of the adjacent emulsion layer of each pair closest to the substrate is at least 0.5 logE units slower than the speed of the adjacent emulsion layer farther from the substrate.

7. A photosensitive element capable of providing a full color image with exposure of at least two silver halide emulsion layers to radiation within the infrared region of the electromagnetic spectrum comprising (a) a substrate, and (b) on one side of said substrate at least three silver halide emulsion layers, each of said silver halide emulsion layers being associated with a means for providing a different color dye image, said three silver halide emulsion layers comprising, in order towards the surface of said photographic element to be exposed, a first emulsion sensitized to a portion of the infrared region of the electromagnetic spectrum, a second emulsion sensitized to a portion of the infrared region of the electromagnetic spectrum which is of a shorter wavelength than the portion to which said first emulsion is sensitized, and a third emulsion sensitized to a portion of the electromagnetic spectrum which is of a shorter wavelength than the portion to which said second emulsion is sensitized, and said three silver halide emulsion layers having a construction selected from the group consisting of:

(1) each of the three layers having a contrast between 0.5 and 12 and the first two layers differing from each other in photographic speed such that, at an optical density of 1.3, speed of the second emulsion layer, and the second emulsion is at least 0.2 logE units faster than the first emulsion layer, and (2) between said first and second emulsion layers is a filter layer absorbing infrared radiation in a range overlapping the region of maximum sensitivity of said second emulsion layer without absorbing more than forty percent of the infrared radiation to which said first emulsion layer is sensitized.

8. The photographic element of claim 7 in which the contrast of each of said at least three silver halide emulsion layers has a contrast between 2 and 8.

9. The photosensitive element of claim 7 in which the construction has at least one filter layer between a pair of adjacent emulsion layers which absorbs between ten and eighty percent of the infrared radiation to which the layer farther from the substrate is sensitized while absorbing less than forty percent of the infrared radiation to which the layer closer to the substrate is sensitized.

10. The photosensitive element of claim 7 in which two filter layers are present, one between said first and a second emulsion layer and one between said second and third emulsion layer, each of said filter layers absorbing at least ten and less than eighty percent of the radiation to which the adjacent layer farther from the substrate is most strongly sensitized while absorbing less than twenty-five percent of the infrared radiation to which the adjacent layer closer to the substrate is sensitized.

11. The photosensitive element of claim 7 in which at least two adjacent emulsion layers differ in their photographic speed and have a contrast between 2 and 5, the speed difference between said two adjacent layers being such that at an optical density of 1.3 the speed of the adjacent emulsion layer closest to the substrate is at least 0.5 logE units slower than the speed of the adjacent emulsion layer farther from the substrate.

12. The photosensitive element of claim 7 in which both pairs of adjacent emulsion layers in a three emulsion layer system differ in their photographic speed and have a contrast between 2 and 5, the speed difference between adjacent layers being such that at an optical density of 1.3 the speed of the adjacent emulsion layer of each pair closest to the substrate is at least 0.5 logE units slower than the speed of the adjacent emulsion layer farther from the substrate.

13. The photosensitive element of claim 7 in which said means of providing a different color comprises a dye-transfer process.

14. The photosensitive element of claim 7 in which said means of providing a different color comprises a dye-bleach process.

15. The photosensitive element of claim 7 in which said means of providing a different color comprises a leuco dye oxidation process.

16. The photosensitive element of claim 7 in which said means of providing a different color comprises the reaction between a photographic color coupler in each emulsion layer with an oxidized color photographic developer.

17. A photosensitive element capable of providing a full color image exposure of at least two silver halide emulsion layers to radiation within the infrared region of the electromagnetic spectrum comprising (a) a substrate, and (b) on one side of said substrate at least three silver halide emulsion layers, each of said silver halide emulsion layers being associated with a means for providing a different color dye image, said three silver halide emulsion layers comprising, a first emulsion sensitized to a portion of the infrared region of the electromagnetic spectrum, a second emulsion sensitized to a portion of the infrared region of the electromagnetic spectrum which is of a shorter wavelength than the portion to which said first emulsion is sensitized, and a third emulsion sensitized to a portion of the electromagnetic spectrum which is of a shorter wavelength than the portion to which said second emulsion is sensitized, and said three silver halide emulsion layers having a construction selected from the group consisting of:

(1) each of the three layers having a contrast between 0.5 and 12 and the first two layers differing from each other in photographic speed such that, at an optical density of 1.3, the speed of the second emulsion layer, is at least 0.2 logE units faster than the first emulsion layer, and (2) between said first and second emulsion layers is a filter layer absorbing infrared radiation in a range overlapping the region of maximum sensitivity of said second emulsion layer without absorbing more than forty percent of the infrared radiation to which said first emulsion layer is sensitized.

18. The photographic element of claim 17 in which the contrast of each of said at least three silver halide emulsion layers has a contrast between 2 and 8.

19. The photosensitive element of claim 18 in which said first and second emulsion layers differ in their photographic speed and have a contrast between 2 and 5, the speed difference between said two adjacent layers being such that at an optical density of 1.3 the speed of the adjacent emulsion layer closest to the substrate is at least 0.5 logE units slower than the speed of the adjacent emulsion layer farther from the substrate.

20. The photosensitive element of claim 18 in which both pairs of adjacent emulsion layers in a three emulsion layer system differ in their photographic speed and have a contrast between 2 and 5, the speed difference between adjacent layers being such that at an optical density of 1.3 the speed of the adjacent emulsion layer of each pair closest to the substrate is at least 0.5 logE units slower than the speed of the adjacent emulsion layer farther from the substrate.

21. The photosensitive element of claim 18 wherein said third emulsion layer is spectrally sensitized to a wavelength within the visible portion of the electromagnetic spectrum and said third emulsion layer is further from the substrate than said first and second emulsion layers.

22. The photosensitive element of claim 18 wherein said third emulsion layer is spectrally sensitized to a wavelength within the visible portion of the electromagnetic spectrum and said third emulsion layer is located between said first and second emulsion layers.

23. The photosensitive element of claim 18 wherein said third emulsion layer is spectrally sensitized to a wavelength within the visible portion of the electromagnetic spectrum and said third emulsion layer is closer to said substrate than said first and second emulsion layers.

24. A color photographic element comprising at least three silver halide emulsion layers on a substrate, each of said three silver halide emulsion layers being capable of forming a single color image of a different color dye, said three silver halide emulsion layers comprising, in any order, a first silver halide emulsion layer sensitized to a portion of the infrared region of the electromagnetic spectrum, a second silver halide emulsion layer sensitized to a different portion of the infrared region of the electromagnetic spectrum, the wavelengths of maximum spectral sensitivity for said first and second layer differing by at least 15 nm, and a third silver halide emulsion layer sensitized to a third portion of the electromagnetic spectrum, the wavelength of maximum spectral sensitivity for said third layer differing by at least 15 nm from the wavelengths of maximum spectral sensitivity of said first and second layers, the sensitivities of each of said three silver halide emulsion layers being such that between any two layers having their maximum sensitivity in the infrared, the emulsion layer having the shorter wavelength of maximum spectral sensitivity has a speed which is at least 0.2 logE units faster than the other of said any two layers.

25. The photographic element of claim 24 in which the contrast of each of said at least three silver halide emulsion layers is between 0.5 and 12.

26. The photographic element of claim 24 in which the contrast of each of said at least three silver halide emulsion layers has a contrast between 2 and 8.

27. The color photographic element of claim 25 wherein the wavelengths of maximum sensitivity for each of said at least three emulsion layers differ from each other by at least 35 nm and the contrast of each of said three emulsion layers is from 1 to 11.

28. The color photographic element of claim 26 wherein the wavelengths of maximum sensitivity for each of said at least three emulsion layers differ from each other by at least 50 nm and the contrast of each of said three emulsion layers is from 2 to 8.

29. The color photographic element of claim 24 wherein between said any two layers, the emulsion layer having the shorter wavelength of maximum sensitivity has a speed which is at least 0.5 logE units faster than the other of said any two layers.

30. The color photographic element of claim 27 wherein between said any two layers, the emulsion layer having the shorter wavelength of maximum sensitivity has a speed which is at least 0.5 logE units faster than the other of said any two layers.

31. The color photographic element of claim 28 wherein between said any two layers, the emulsion layer having the shorter wavelength of maximum sensitivity has a speed which is at least 0.5 logE units faster than the other of said any two layers.

32. The color photographic element of claim 24 wherein said means for providing a different color dye image is a photographic color coupler.

33. The color photographic element of claim 26 wherein said means for providing a different color dye image is a photographic color coupler.

34. The color photographic element of claim 30 wherein said means for providing a different color dye image is a photographic color coupler.

35. The color photographic element of claim 24 wherein said means for providing a different color dye image is diffusion transfer.

36. The color photographic element of claim 26 wherein said means for providing a different color dye image is diffusion transfer.

37. The color photographic element of claim 30 wherein said means for providing a different color dye image is diffusion transfer.

* * * * *